United States Patent [19]

van der Wilk

[11] Patent Number: 5,010,275

[45] Date of Patent: Apr. 23, 1991

[54] ELECTRON TUBE DEVICE AND ELECTRON TUBE

[75] Inventor: Ronald van der Wilk, Eindhoven, Netherlands

[73] Assignee: U.S. Philips Corporation, New York, N.Y.

[21] Appl. No.: 337,241

[22] Filed: Apr. 13, 1989

[30] Foreign Application Priority Data

Apr. 20, 1988 [NL] Netherlands ..... 8801016

[51] Int. Cl.[5] ..... H05B 41/36

[52] U.S. Cl. ..... 315/106; 315/94; 315/309; 313/422; 313/364

[58] Field of Search ..... 315/94, 97, 98, 105, 315/106, 107, 50, 366, 309; 335/212; 328/69, 123, 255, 249, 270, 267; 313/422, 364, 400

[56] References Cited

U.S. PATENT DOCUMENTS 4,167,690 9/1979 Gange ..... 315/366

4,651,058 3/1987 Hamada et al. ..... 315/98

*Primary Examiner*—Eugene R. LaRoche

*Assistant Examiner*—Ali Neyzari

*Attorney, Agent, or Firm*—Robert J. Kraus

[57] ABSTRACT

An electron tube device comprising an electron tube having a line cathode, and an electric power source for supplying power pulses to the line cathode. The electron tube device comprises determination means for determining, during a power pulse, the value of a physical quantity which depends on the temperature of the line cathode, comparison means for comparing the value with a reference value and for supplying a control signal, and termination means to end the power pulse in dependence on the control signal. Consequently, the temperature of the line cathode is more stable.

7 Claims, 4 Drawing Sheets

ELECTRON TUBE DEVICE AND ELECTRON TUBE

BACKGROUND OF THE INVENTION

The invention relates to an electron tube device comprising an electron tube having at least one line cathode, and an electric power source for the supply of power pulses to the line cathode.

Such an electron tube device is known from U.S. Pat. No. 4,167,690, in which a description is given of a display device having a line cathode which is heated by means of power pulses. Between each consecutive pair of pulses there is an interval. During this interval an electron flow is extracted from the line cathode. This electron flow is modulated by a modulation system and an image is displayed on a display screen.

It has been found that after such an electron tube device is switched on, relatively rapidly varying initial changes occur during the transient time in the number of electrons emitted per unit of time by the line cathode. Also during the life cycle of the electron tube device slowly varying temporal changes occur in the number of electrons emitted. In a display device these changes reveal themselves as changes in the intensity of the image displayed, which is undesired.

SUMMARY OF THE INVENTION

It is an object of the invention to provide an electron tube device in which the changes in the number of electrons emitted per unit of time by the line cathode are reduced.

To this end, an electron tube device of the type described in opening paragraph is characterized in that the electron tube device comprises determination means for determining a value of a physical quantity depending on the temperature of the line cathode during a power pulse, comparison means for comparing the value with a reference value and for supplying a control signal, and termination means for ending the relevant power pulse in dependence on the control signal.

It has been found that in an electron tube device in accordance with the invention the transient time and the temporal changes in the number of electrons emitted are reduced.

The invention is based on the insight that the temperature of the line cathode does not only depend on the power supplied to the line cathode but also on the heat dissipated by the line cathode and other factors such as the mass of the line cathode.

The line cathode dissipates heat by, inter alia, radiation and conduction. The amount of radiation heat depends, amongst others, on the temperature, the emissivity and the size of the surface of the line cathode and the ambient temperature, i.e., the temperature of the surroundings of the line cathode. The amount of heat which is conducted away depends, inter alia, on the manner in which the line cathode and the ambient temperature. If the power supplied remains constant, changes in, for example, the ambient temperature or the emissivity of the surface of the line cathode lead to changes in the temperature of the line cathode and, thus, to changes in the number of electrons emitted.

In the prior-art-method, the power supplied to the line cathode is constant. As a result hereof, the temperature of the line cathode is subject to changes during operation. Moreover, at a predetermined power supply the temperature of the line cathode cannot be accurately predicted.

In an operational electron tube device in accordance with the invention, the value of a temperature-dependent physical quantity is determined during a power pulse, and the power pulse is ended if a comparison of this value with a reference value shows that the temperature of the line cathode exceeds a temperature which corresponds to the reference value.

Thus, the power supplied to the line cathode depends on the value of the physical quantity and, hence, on the temperature of the line cathode, as a result of which an improved adjustment of the number of electrons emitted by the line cathode is achieved and the transient time, i.e. the time during which important initial variations in the number of electrons emitted occur, is reduced.

A preferred embodiment of the line-cathode arrangement in accordance with the invention is characterized in that the determination means can suitably be used for determining a physical quantity of the line cathode.

In this case, the temperature of the line cathode is determined in a direct manner. The temperature of the line cathode can be determined indirectly, for example via the ambient temperature of the line cathode; the disadvantage of indirect temperature control relative to direct temperature determination is that both the possibility and the extent of the changes in the temperature of the line cathode are increased.

Temperature-dependent properties of the line cathode may be, amongst others, the tensile load on the wire, the length of the wire, the electromagnetic radiation emitted, of which both the intensity and the frequency distribution are temperature-dependent, the number of electrons emitted per unit of time by the line cathode and the velocity distribution among these electrons, and the electrical resistance.

A further embodiment of an electron tube device in accordance with the invention is characterized in that the determination means are at least partly present in the electron tube and are suitable for determining the number of electrons emitted per unit of time by the line cathode. During operation, the number of electrons emitted per unit of time is determined during a pulse and compared with a reference quantity; if the number is larger than the reference quantity the power pulse is ended. Thus, the number of electrons emitted per unit of time substantially corresponds to the desired number. This is a simple and direct manner of controlling the number of electrons emitted per unit of time. A disadvantage is that additional elements are accommodated in the electron tube, which are provided with connections. Consequently, the construction of the electron tube becomes more complicated and, moreover, there is a risk that the determination means or their connections may break. Since these means are present in the electron tube, it is difficult, or even impossible, to repair them.

An alternative embodiment of an electron tube device in accordance with the invention is characterized in that the determination means comprise means for determining the resistance.

This permits a simple way of controlling the temperature without the necessity of additional elements in the electron tube and with only a minimum number of additional connections being required.

Yet a further embodiment of an electron tube device, in which the power source can suitably be used to apply a voltage drop across the line cathode within power pulses having a substantially constant current value, is characterized in that the means for determining the resistance comprise an arrangement for determining the voltage drop across the line cathode.

This is a simple way of determining the resistance, which has little influence on the temperature of the line cathode.

A further embodiment of an electron tube device in accordance with the invention is characterized in that the electron tube device comprises calibration means for determining a calibration value of the physical quantity, at a calibration temperature, and means for determining the reference value in dependence on the calibration value. If the calibration value has been determined at a known calibration temperature, the dependence of the physical quantity on the temperature is known. The reference value can be determined more accurately and compensated for changes in the calibration value during the life cycle of the electron tube device.

The invention can advantageously be used, in particular, in an electron tube device in which the electron tube is provided with a system of line cathodes. In the case of electron tube devices having a number of line cathodes it is important that the number of electrons emitted per unit of time by the different line cathodes is equal to the extent possible so that there are no differences in intensity.

This is important for, in particular, flat picture tubes.

BRIEF DESCRIPTION OF THE DRAWING

A few exemplary embodiments of the invention will now be described in more detail with reference to the drawing, in which.

The Figures are diagrammatic representations and are not drawn to scale, corresponding parts in the different embodiments generally bearing the same reference numerals.

DESCRIPTION OF THE PREFERRED EMBODIMENTS

Figure 1:
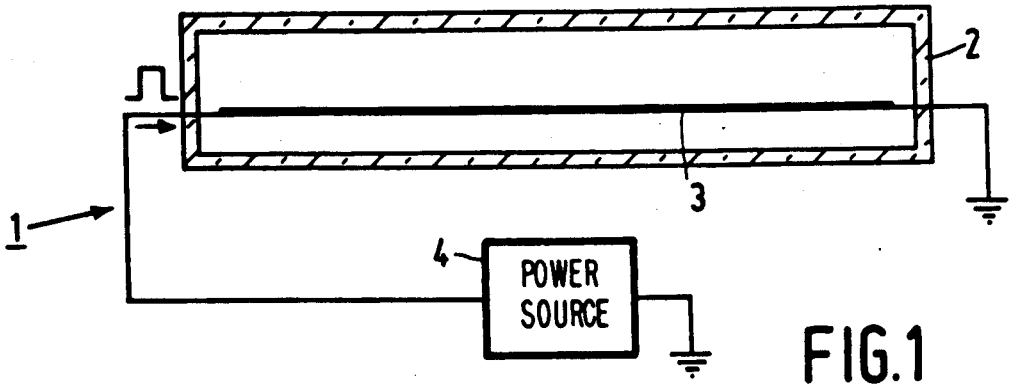
FIG.1 PRIOR ART
FIG. 1 is a diagrammatic, sectional view of an electron tube device in accordance with the present state of the art.

FIG. 1 shows an electron tube device known from the present state of the art. An electron tube device 1 comprises an electron tube 2 containing a line cathode 3, and a power source 4. Power pulses generated by the power source 4 are supplied to the line cathode 3. The pulse duration is approximately 10μs, the interval, i.e. the time between the end of a power pulse and the beginning of the next power pulse is approximately 50μs. During the interval no voltage drop is applied across the line cathode. As has been described hereinbefore, the disadvantage of this known method is that the temperature of the line cathode cannot be accurately controlled and is subject to changes because the temperature does not only depend on the power supplied. A further disadvantage of the known state-of-the-art method is that if use is made of power pulses having a constant current value there is the risk of an excessive increase of the temperature of the line cathode. This disadvantage will be described hereinbelow by means of FIG. 7.

Figure 2:
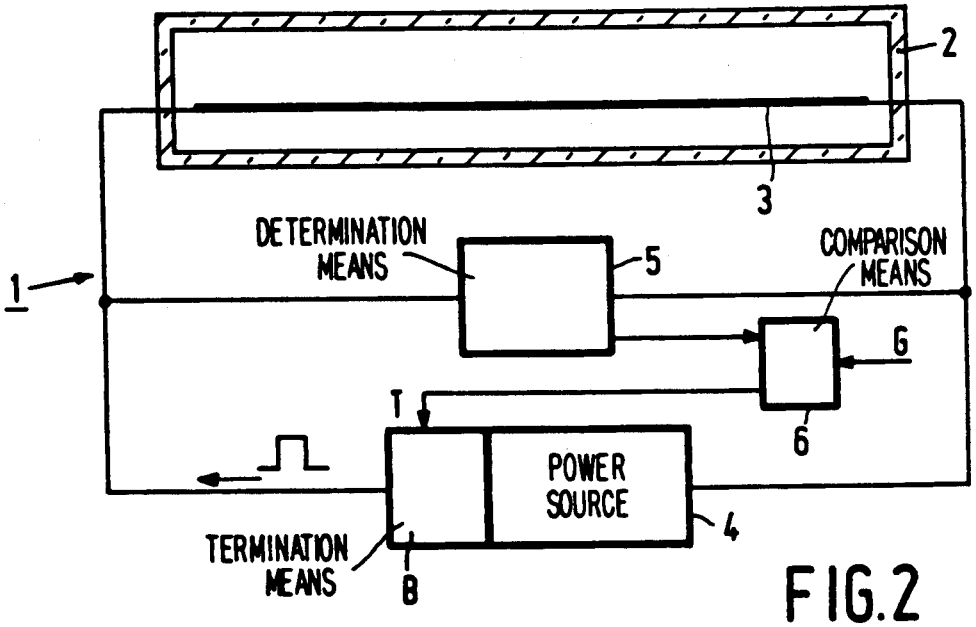
FIG. 2 is a diagrammatic sectional view of an electron tube device accordance with the invention.

FIG. 2 shows and electron tube device in accordance with the invention. Power pulses generated by power source 4 are supplied to the line cathode 3. During a power pulse the value of a physical quantity which depends on the temperature of the line cathode is determined by means of a determination means 5. In a comparison means 6 the value is compared with a reference value G. A control signal T is generated by the comparison means 6 and is supplied to a termination means B. If the control signal indicates that the temperature of the line cathode exceeds a reference temperature corresponding to the reference value, the power pulse is ended, i.e. the voltage drop across the line cathode 3 is reduced to substantially nil. The termination means B may be contained in the power source 4.

Figure 3:
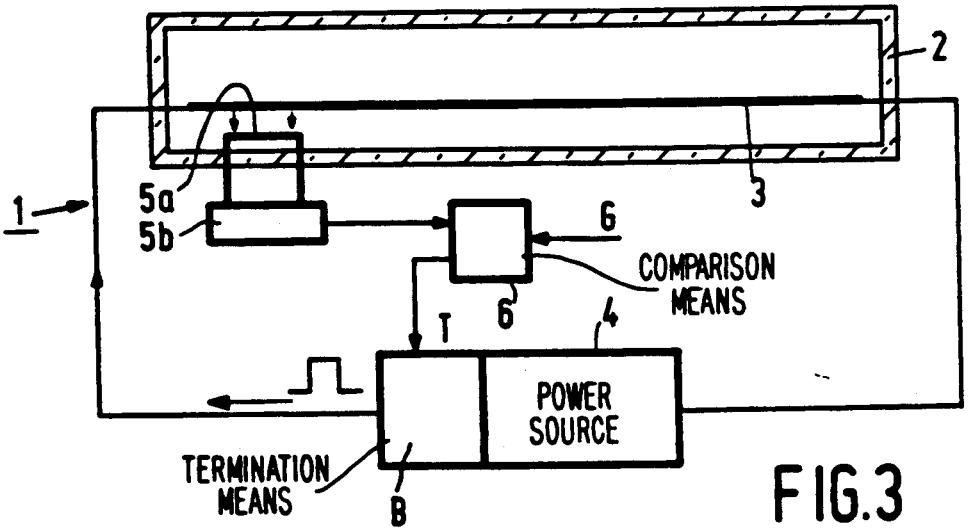
FIGS. 3, 4 and 5 are sectional views of further examples of electron tube devices in accordance with the invention.

FIG. 3 is a diagrammatic view of embodiment of an electron tube device in accordance with the invention. Determination means 5 comprise a portion 5*a* in the electron tube. This portion is used to measure the number of electrons emitted per unit of time. In the comparison means 6 the number is compared with a reference number. If the number exceeds the reference number, the power pulse is ended.

Figure 4:
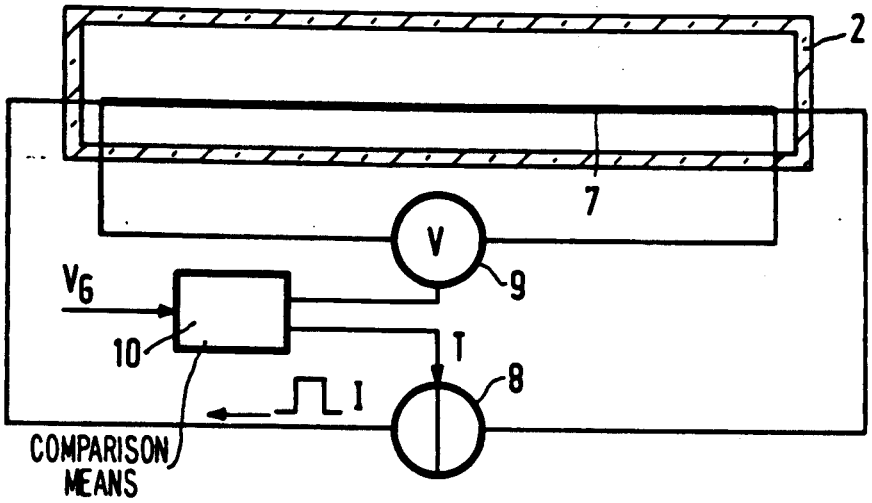

FIG. 4 is an alternative embodiment of an electron tube device in accordance with the invention. Power pulses having a constant current are supplied to a line cathode 7 by a current source 8. During a power pulse the voltage drop across the line cathode is measured by means of a voltmeter 9. This voltage drop is compared with a calibration value $V_G$ in a comparison means 10. The resistance changes as the temperature of the line cathode increases, in general the resistance will increase. The voltage drop across the line cathode increases. If the voltage drop exceeds the calibration value $V_G$ the current through the line cathode is reduced to nil by means of a control signal T, and the power pulse is ended.

Figure 5:
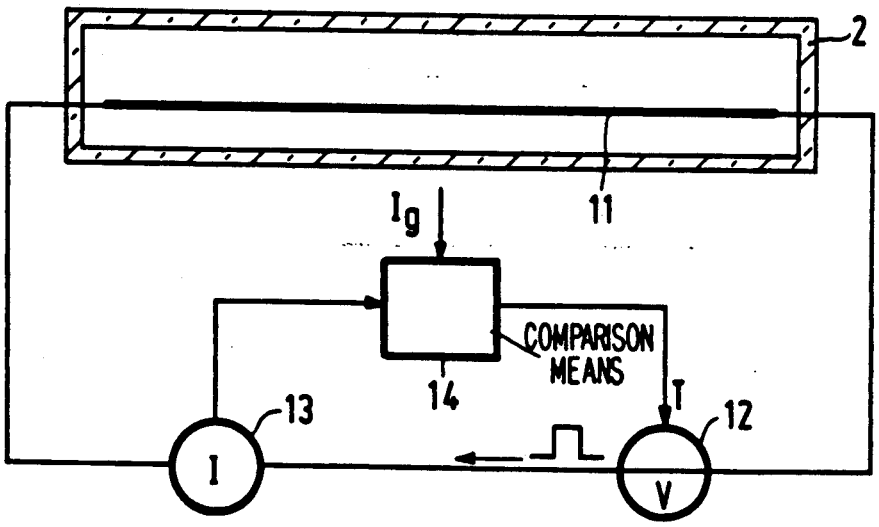

FIG. 5 shows an alternative embodiment of the electron tube device in accordance with the invention. Power pulses having a constant voltage are applied to a line cathode 11 by a voltage source 12. During a power pulse the current passing through the line cathode is measured by means of a current meter 13. This current is compared with a reference value $I_G$ in a comparison means 14. The resistance changes as the temperature of the line cathode increases, in general the resistance value will increase. The current passing through the line cathode will decrease. If this current becomes smaller than the reference value $I_G$ the voltage drop across the wire is reduced to nil by means of a control signal T.

Figure 6:
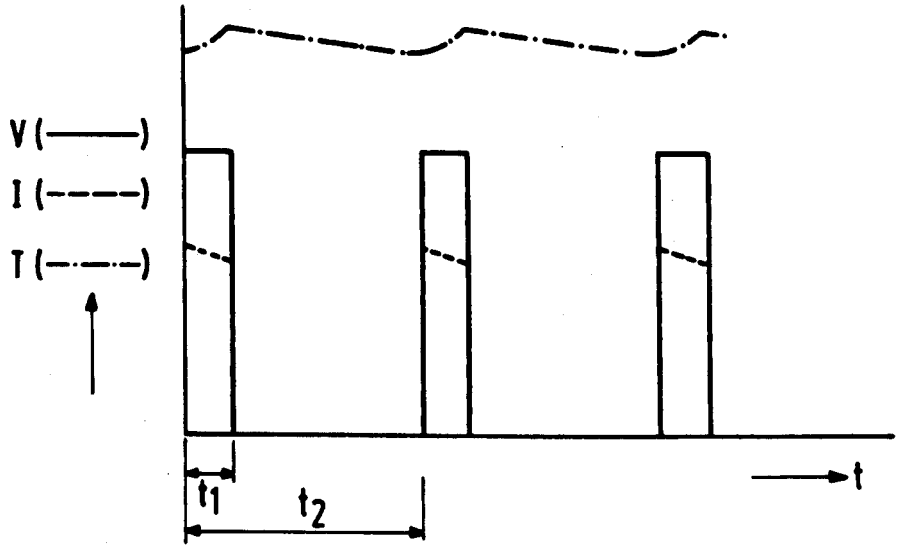
FIG.6 PRIOR ART
FIG. 6 graphically represents, as a function of time, the voltage drop across, the current through and the temperature of the line cathode for the known electron tube device if power pulses having a constant voltage drop value are supplied to the line cathode.

FIG. 6 is a graphic representation, as a function of time, of the voltage drop across, the current passing through and the temperature of the line cathode for the known electron tube device, in which power pulses having a constant value of the voltage drop are supplied to the line cathode. The horizontal axis represents the time in arbitrary units, the vertical axis represents the voltage drop across the line cathode (V, represented by means of a continuous line), the current passing through the line cathode (I, represented by an interrupted line) and the temperature of the line cathode (T, represented by a chain line). During a power pulse duration $t_1$ a power pulse having a constant voltage is supplied to the line cathode. The temperature of the line cathode increases and, consequently, the resistance of the line cathode increases, and the current decreases. During the interval between two power pulses, $t_2-t_1$, no power is supplied to the line cathode and the temperature of the line cathode decreases. After a number of power pulses an equilibrium is established such that the average power supplied to the line cathode equals the heat dissipated by the line cathode. Both the power supplied and the dissipated heat depend themselves on the temperature of the line cathode. As the temperature of the line cathode increases, the average power supplied to the line cathode decreases, and the dissipated heat by the line cathode increases. The heat dissipated depends on the ambient temperature and on the thermal coupling between the line cathode and its environment. The temperature of the line cathode is stable only if the ambient temperature is stable. The time necessary to obtain a stable ambient temperature generally exceeds by far the warming-up time of a line cathode. Moreover, the thermal coupling between the line cathode and its environment may change during the life cycle of the line cathode. Moreover, in the case of a display device comprising more than one line cathode, the individual line cathodes have different ambient temperatures, even if the ambient temperature is stable for each line cathode, so that temperature differences between line cathodes occur and, hence, for example, differences in intensity in the image displayed are obtained.

Figure 7:
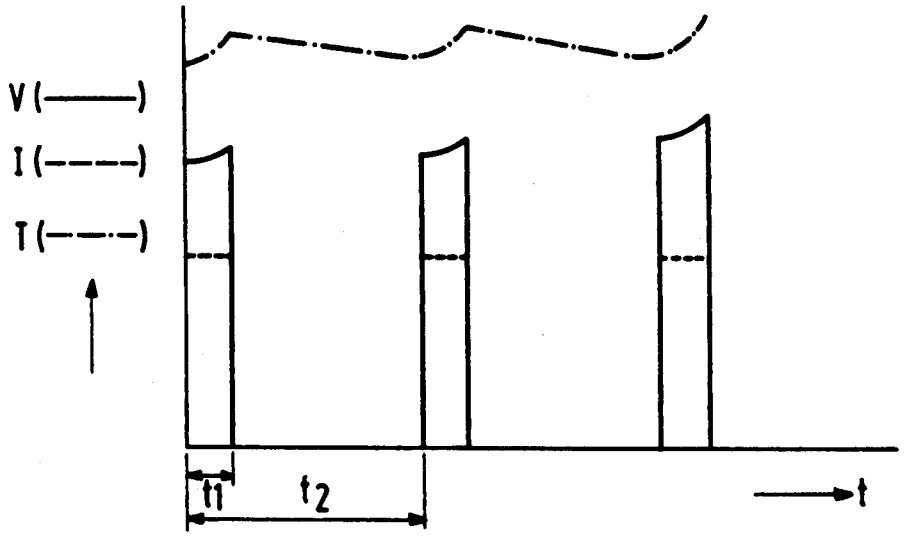
FIG.7 PRIOR ART
FIG. 7 graphically represents, as a function of time, the voltage drop across, the current through and the temperature of the line cathode for the known electron tube device, if power pulses having a constant current value are supplied to the line cathode.

FIG. 7 is a graphic representation, as a function of time, of the voltage drop across, the current passing through and the temperature of the line cathode for the known electron tube device, power pulses having a constant current being supplied to the line cathode. On the horizontal and vertical axes the same quantities are plotted as in FIG. 6. U.S. Pat. No. 4,167,690 advises against supplying power pulses having a constant current intensity to the line cathode because the power supply to the line cathode increases as the temperature of the line cathode increases and, consequently, the line cathode may be heated to an intolerably high temperature.

Figure 8:
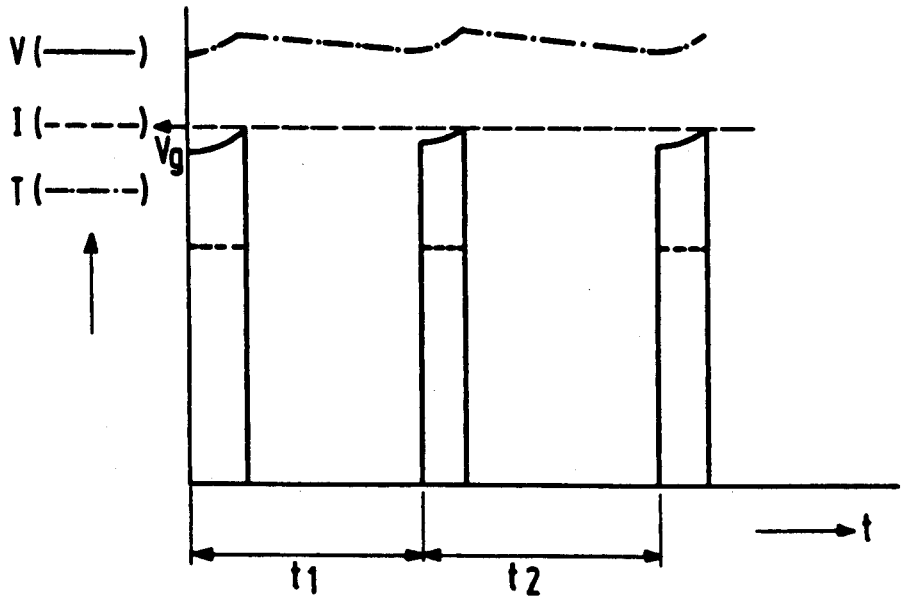
FIG. 8 graphically represents, as a function of time, the voltage drop across, the current through and the temperature of the line cathode for the electron tube device in accordance with the invention, if power pulses having a constant current value are supplied to the line cathode.

FIG. 8 is a graphic representation, as a function of time, of the voltage drop across, the current passing through and the temperature of the line cathode for the electron tube device in accordance with the invention, power pulses having a constant current intensity being supplied to the line cathode. On the horizontal and vertical axes the same quantities are plotted as in FIGS. 6 and 7. Power pulses having a constant current intensity are supplied to the line cathode. During a power pulse the temperature of the line cathode increases, the resistance of the line cathode increases as a consequence thereof and, hence, the voltage drop across the line cathode increases. If this voltage drop exceeds a reference value $V_G$ the power supplied to the line cathode is reduced to nil. It has been found that in this way a quicker and more accurate temperature stabilization of the line cathode is obtained because the equilibrium temperature is independent of factors outside the line cathode.

Figure 9:
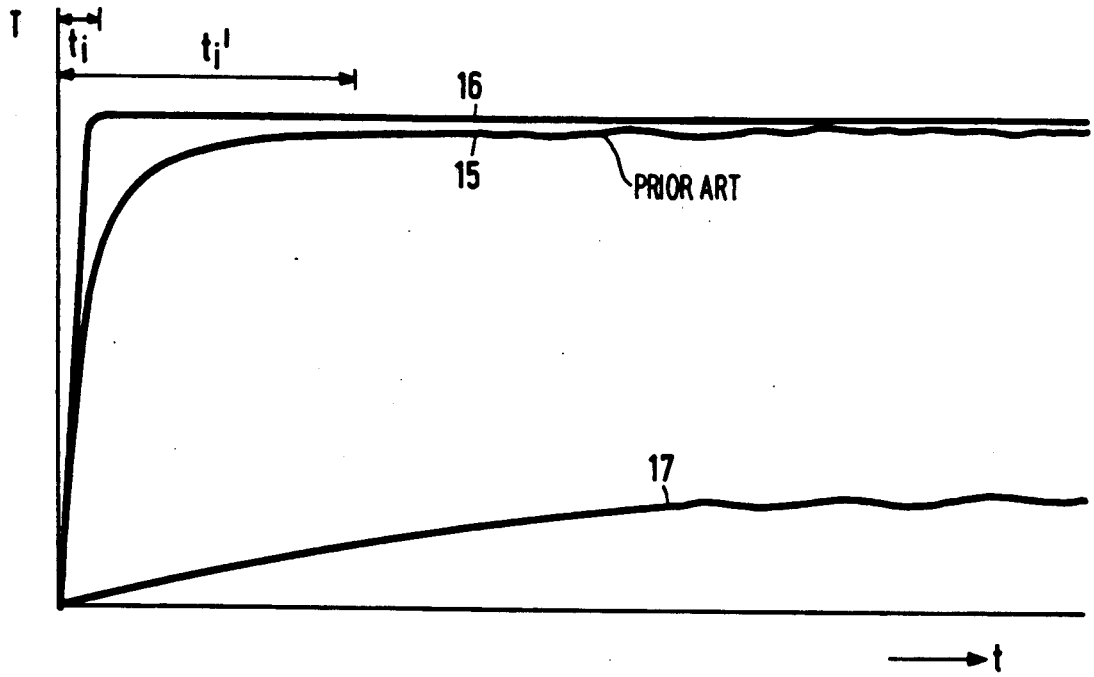
FIG. 9 graphically represents a comparison between the temperatures of a line cathode in an electron tube device known from the present state of the art and the temperature of a line cathode in an electron tube device in accordance with the invention.

FIG. 9 graphically shows a comparison between the temperatures of a line cathode in an electron tube device in accordance with the present state of the art and the temperatures of a line cathode in an electron tube device in accordance with the invention. The time after the switching-on of the electron tube device is plotted on the horizontal axis and the temperature is plotted on the vertical axis. A curve 15 shows the temperature of a line cathode in an electron tube device known from the present state of the art, a curve 16 shows a line cathode in an electron tube device in accordance with the invention. The temperature of a line cathode in an electron tube device in accordance with the invention rises very rapidly to the desired value, after which it remains substantially constant; during the transient time, $t_1$, the line cathode is warmed up very quickly. The temperature of a line cathode in an electron tube device in accordance with the present state of the art depends on the ambient temperature of the line cathode. This ambient temperature is represented by a curve 17. The temperature of the line cathode in a line cathode arrangement in accordance with the present state of the art initially rises just as quickly as in the case of the invention, but subsequently it rises slowly asymptotically, in a time $t_1$, to an equilibrium value. This equilibrium value is not known a priori, it will be different for different line cathodes and it depends on the ambient temperature. A change in the ambient temperature influences this equilibrium temperature.

Figure 10:
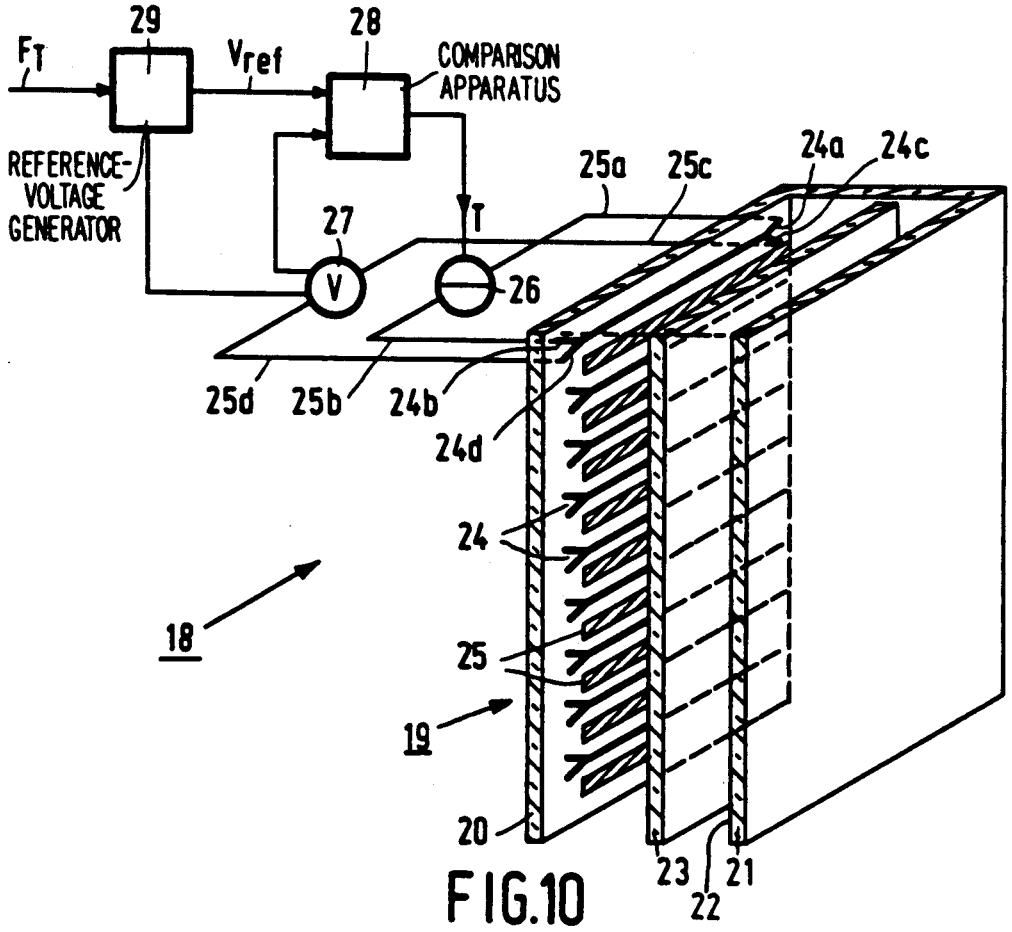
FIG. 10 is a partly perspective view of a further example of an electron tube device in accordance with the invention.

FIG. 10 is a partly perspective view of a display device 18 in accordance with the invention, in this case it is provided with a flat cathode ray tube 19 having a rear plate 20, a glass front plate 21 which is provided on the inside with a pattern of phosphors 22, a system of selection electrodes 23 and a system of parallel line cathodes 24. These line cathodes 24 are connected at both ends to at least two electrically conductive connection means; in the present example all line cathodes are provided with connections 24*a* up to and including 24*d*. For the sake of clarity a part of the envelope has been left out. Deflection electrodes 25 are present between the line cathodes 24. The electrons emitted by the line cathodes 24 are deflected by deflection electrodes 25, they are selected by selection electrodes 23 and are incident on the phosphor pattern 22 at the location of front plate 21. An image is formed on the phosphor pattern by a suitable selection of the potentials at the deflection electrodes and selection electrodes. The Figure schematically shows that the connections 24*a* and 24*b* are connected to a pulsated current source 26 by means of lines 25*a* and 25*b*. The connections 24*c* 24*d* are connected to a voltmeter 27 by means of lines 25*c* and 25*d*. The reading of this voltmeter is compared with a reference voltage $V_{ref}$ in a comparison apparatus 28.

This apparatus supplies a control signal to the current source 26. The drawing also schematically shows how a further improvement of the temperature control can be obtained. The resistance of each line cathode is given by $R(T)=F(T/T_O)^*R(T_O)$, i.e., knowing the resistance at a known temperature, $T_O$ suffices to find out the resistance at other temperatures. In general, the line cathodes in a flat display tube are made so as to be as identical as possible. However, there is no certainty as to whether the resistance values are indeed identical and will remain so during the life cycle of the tube. In order to reduce any differences in temperature occurring as a result hereof, the resistance of each line cathode is determined at room temperature. This may be carried out, for example, by passing a very low current, which is equal for each line cathode, through each line cathode and measuring the voltage drop across each line cathode immediately after switching on the display device. In this way, the resistance of each line cathode is determined at room temperature. Dependent upon this $V_{ref}$ is determined for each line cathode in part 29. If, for example, the resistance at room temperature of three line cathodes is 95, 100 and 105 Ω, respectively, and the reference voltage drop corresponding to the desired temperature and the constant current intensity is 100 V for the line cathode having a resistance of 100 Ω, the reference voltage drop of the other line cathodes is 95 and 105 V, respectively. In this way, differences in temperature between the line cathodes are reduced.

It will be clear that within the scope of the invention many variations are possible to those skilled in the art.

I claim:

1. In an electron display tube apparatus including an envelope containing a line cathode and including an electric power source for repetitively supplying power pulses to the line cathode, the improvement comprising means for controlling the line cathode temperature, said means including:

a. termination means electrically connected to the power source and having an input for receiving a control signal, said termination means effecting termination of each of the power pulses when the control signal is applied to the input;

b. determination means coupled to the line cathode for directly determining the temperature of said cathode and for producing a value representative of said temperature;

c. comparison means electrically connected to the determination means and to the input of the termination means, said comparison means producing said control signal when the value representative of the line cathode temperature reaches a predetermined magnitude, thereby effecting termination of the pulse instantaneously being supplied to the line cathode.

2. An apparatus as in claim 1 where the determination means is electrically connected to the line cathode for determining the electrical characteristic of said cathode representative of the temperature of said cathode and for producing said value from said determination.

3. An apparatus as in claim 2 where at least a part of the determination means is disposed in the envelope for instantaneously determining the rate of emission of electrons from the line cathode, said rate being representative of the line cathode temperature.

4. An apparatus as in claim 2 where the determination means effects determination of the resistance of the line cathode, said resistance being representative of the line cathode temperature.

5. An apparatus as in claim 4 where the power source supplies constant current power pulses to the line cathode which effect a voltage drop across said line cathode, and where the determination means determines said resistance by determining the magnitude of said voltage drop.

6. An apparatus as in claim 1 or 2 including a calibration means for determining, from the value produced by the determination means at a calibration temperature of the line cathode, the value representative of the line cathode temperature at the predetermined magnitude.

7. An apparatus as in claim 1 or 2 where said envelope contains a plurality of line cathodes and where the means for controlling the line cathode temperature is adapted for individually controlling the temperatures of respective ones of said cathodes.

* * * * *